US007421788B2

(12) United States Patent
Gardner et al.

(10) Patent No.: US 7,421,788 B2
(45) Date of Patent: Sep. 9, 2008

(54) CUTTING TOOL FOR A STRAP

(75) Inventors: Joseph J. Gardner, Elk Grove Village, IL (US); John A. Rometty, Barrington, IL (US)

(73) Assignee: Illinois Tool Works Inc., Glenview, IL (US)

( * ) Notice: Subject to any disclaimer, the term of this patent is extended or adjusted under 35 U.S.C. 154(b) by 208 days.

(21) Appl. No.: 11/162,384

(22) Filed: Sep. 8, 2005

(65) Prior Publication Data

US 2007/0050985 A1 Mar. 8, 2007

(51) Int. Cl.
*B26B 13/00* (2006.01)

(52) U.S. Cl. ..... 30/131; 30/233; 30/257

(58) Field of Classification Search ..... 30/231–233, 30/131, 257, 135; D8/57
See application file for complete search history.

(56) References Cited

U.S. PATENT DOCUMENTS

| | | | | | |
|---|---|---|---|---|---|
| 208,046 | A * | 9/1878 | Snediker | 30/135 |
| 215,943 | A * | 4/1879 | Miller | 30/135 |
| 417,366 | A * | 12/1889 | Phippen et al. | 30/131 |
| 579,093 | A * | 3/1897 | Kelly | 30/135 |
| 867,514 | A * | 10/1907 | King | 30/135 |
| 1,055,910 | A * | 3/1913 | Hoover | 30/135 |
| 1,251,101 | A * | 12/1917 | Quigley | 30/233 |
| 2,648,901 | A * | 8/1953 | Northcutt | 30/131 |
| 3,010,206 | A * | 11/1961 | Curry | 30/131 |
| 3,237,302 | A * | 3/1966 | Fennell | 30/135 |
| 3,237,303 | A * | 3/1966 | Fennell | 30/135 |
| 3,877,145 | A * | 4/1975 | Andrews | 30/233 |
| 4,099,326 | A * | 7/1978 | Mori et al. | 30/135 |
| 4,227,305 | A * | 10/1980 | Newman | 30/233 |
| 4,272,888 | A * | 6/1981 | Hartmeister | 30/233 |
| 4,753,011 | A * | 6/1988 | Long | 30/258 |
| 4,850,110 | A * | 7/1989 | Meier, Jr. | 30/135 |
| 6,038,772 | A * | 3/2000 | Cornell et al. | 30/233 |
| 6,145,203 | A * | 11/2000 | Appleman | 30/233 |
| 6,418,625 | B1 * | 7/2002 | Baum | 30/233 |
| 6,513,247 | B1 * | 2/2003 | Krasik-Geiger et al. | 30/233 |
| 6,973,725 | B2 * | 12/2005 | Lai | 30/233 |
| 2005/0097758 | A1 * | 5/2005 | Elkins | 30/233 |

* cited by examiner

*Primary Examiner*—Jason Prone
(74) *Attorney, Agent, or Firm*—Mark W. Croll; Donald J. Breh; Levenfeld Pearlstein, LLC

(57) ABSTRACT

A cutting tool for strap includes a fixed element and a movable element pivotally operably connected to one another. The fixed element has a body, a grip extending from an end of the body and an anvil. The anvil has a cutting edge. A pivot region is defined between the cutting edge and the grip. The movable element has a body, an enclosed handle and a cutting head. The cutting head defines a cutting edge. A pivot region is defined between the cutting edge and the handle. The movable and fixed elements are operably connected at their respective pivot regions. A cutter guard having a flange is disposed to overlie a portion of the fixed element anvil to provide an opening between the flange and the anvil to place the strap during a cutting operation.

7 Claims, 2 Drawing Sheets

CUTTING TOOL FOR A STRAP

BACKGROUND OF THE INVENTION

The present invention relates to a cutting tool for strap. More particularly, the present invention relates to an enclosed handle tool for cutting metal and plastic strap.

Strapping material is used in a wide variety of applications to secure or bundle loads. The strap material is typically metal or plastic and can be applied to the load using either a manual strapper or a powered (e.g., electric or pneumatic) strapper. The strap material is tensioned as it is secured to itself to bundle the load.

In order to remove the tensioned strap, it is often necessary to cut or sever the strap. In that the strap can be quite strong, and under considerable tension, it is necessary that the cutter be strong and ergonomically designed.

One known cutter includes a fixed handle with a foot for resting on the load and a movable handle that pivots about the fixed handle. A cutting blade is separate and apart from both the fixed and movable handles and is mounted to the movable handle by a pin. The fixed and movable handles are both open handles to provide gripping and pulling members. Although this type of cutter functions well, because of the open handles, it is not an ergonomically optimal design.

Moreover, when using such a tool, the operator typically holds the strap down with one hand while using the other hand to operate the tool (i.e., to cut the strap).

Accordingly, there is a need for a cutting tool for strap that includes an ergonomically designed body. Desirably such a cutting tool is usable for cutting any conventional strap without the need for a separate cutting blade within and part of the tool. More desirably, such a cutting tool holds the strap in the tool during the cutting operation.

SUMMARY OF THE INVENTION

A cutting tool for strap includes a fixed element and a movable element operably connected to one another by a pivot. The fixed element has a body, a grip extending from an end of the body and an anvil. The anvil has a cutting edge. A pivot region is defined between the cutting edge and the grip.

The movable element has a body, an enclosed handle and a cutting head. The enclosed handle is formed as a loop. The cutting head defines a cutting edge. A pivot region is defined between the cutting edge and the handle.

The movable and fixed elements are operably connected at their respective pivot regions by a pivot pin. A cutter guard having a flange is disposed to overlie a portion of the fixed element anvil to provide an opening between the flange and the anvil to place the strap during a cutting operation. The guard holds the strap at the anvil to prevent recoil when the strap is cut.

In a present embodiment, the cutter guard includes a body that is disposed, in part, between the fixed and the movable elements. The guard can be formed as L-shaped element with the base of the L forming the flange.

A present embodiment of the tool includes a foot on the fixed element such that the anvil is formed integral with the foot. The movable element cutting head includes a back side opposite of the cutting edge that has a curved profile.

The movable element can include an inwardly projecting stub between the pivot region and the handle and the fixed element can include an inwardly projecting stub between the pivot region and the grip opposite of the movable element stub. A biasing element, such as a spring can be positioned between the elements at the stubs to bias the tool to an open position.

These and other features and advantages of the present invention will be readily apparent from the following detailed description, in conjunction with the claims.

BRIEF DESCRIPTION OF THE DRAWINGS

The benefits and advantages of the present invention will become more readily apparent to those of ordinary skill in the relevant art after reviewing the following detailed description and accompanying drawings, wherein.

DETAILED DESCRIPTION OF THE INVENTION

Figure 1:
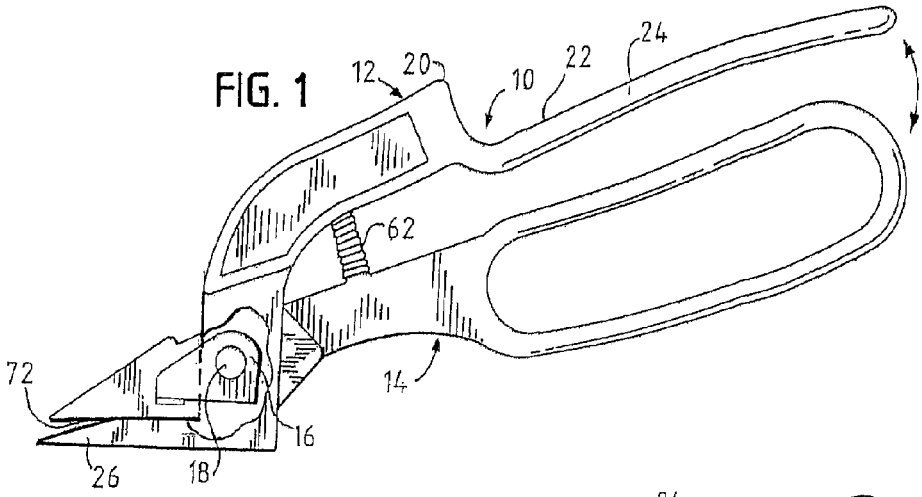
FIG. 1 is a side view of a cutting tool for strap embodying the principles of the present invention, the fixed element being shown partially broken away to better illustrate the cutter guard.
Figure 1A:
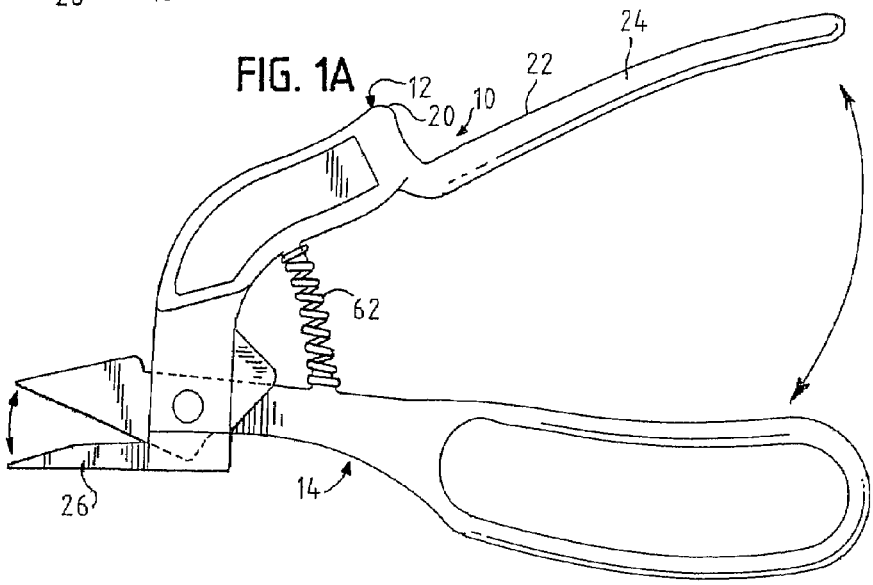
Figure 2:
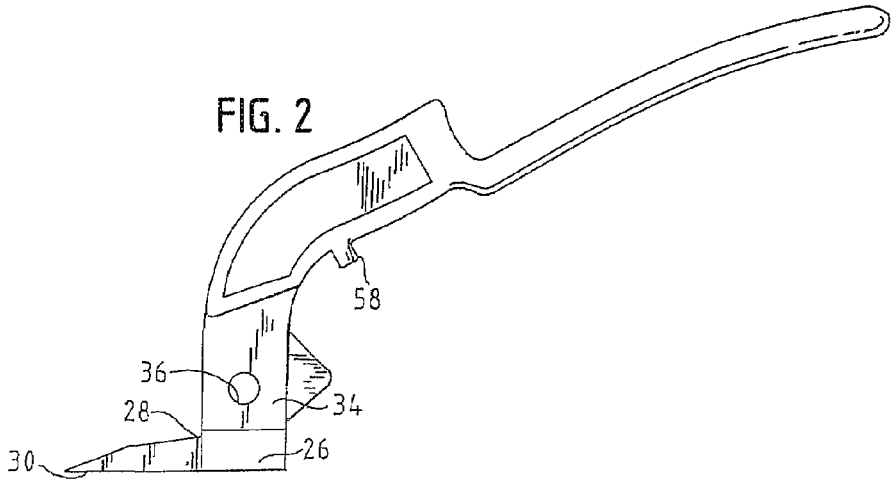
FIG. 2 is a side view of the fixed element of the tool.
Figure 3:
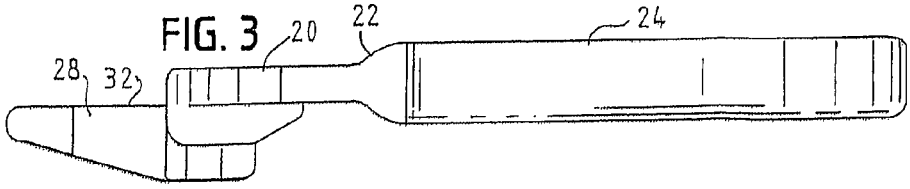
FIG. 3 is a top view of the fixed element.
Figure 4:
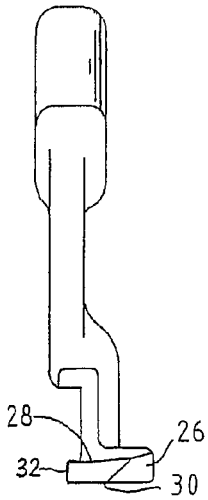
FIG. 4 is a front view of the fixed element.
Figure 5:
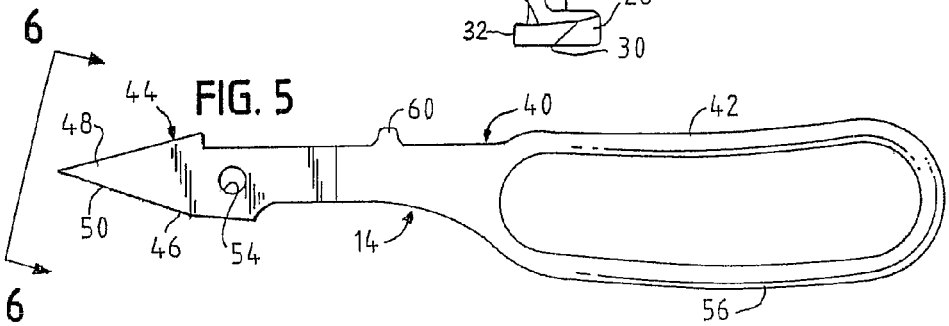
FIG. 5 is a side view of the movable element of the tool.
Figure 6:
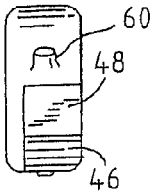
FIG. 6 is a front view of the movable element.
Figure 7:
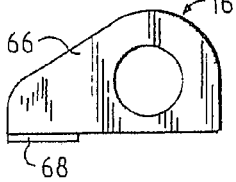
FIG. 7 is a side view of the cutter guard of the tool.
Figure 8:
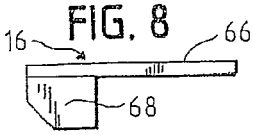
FIG. 8 is a top view of the cutter guard.

While the present invention is susceptible of embodiment in various forms, there is shown in the drawings and will hereinafter be described a presently preferred embodiment with the understanding that the present disclosure is to be considered an exemplification of the invention and is not intended to limit the invention to the specific embodiment illustrated.

It should be understood that the title of this section of this specification, namely, "Detailed Description of the Invention", relates to a requirement of the United States Patent Office, and does not imply, nor should be inferred to limit the subject matter disclosed herein.

Referring now to the figures and in particular to FIG. 1, there is shown a cutting tool 10 for strap embodying the principles of the present invention. The tool 10 includes generally, a fixed element 12, a movable or pivoting element 14 and a cutter guard 16. The elements 12, 14 are mounted to one another, with the guard 16 between the elements, by a pin 18 or like element. In this pinned manner, the elements 12, 14 pivot relative to one another and the guard 16 remains relatively fixed between the fixed elements 12 and pivoting element 14.

The fixed element 12 includes a body 20, a handle 22 having a grip 24, a foot 26 and an anvil 28. The anvil 28 is formed integral with the foot 26. The body 20 and grip 24 are curved to facilitate cutting (e.g., to permit using leverage to cut the strap), and to permit comfortable placement of a user's hand on the handle 22.

The foot 26 is provided With a generally flat surface 30 to rest on the load. An upper part of the foot 26 defines the anvil 28 which includes a cutting edge 32 (or fixed blade) that, with the movable element 14, severs the strap as the elements 12, 14 are urged together. A pivot region 34 is positioned between the foot 26 and the handle 22 (as part of the body 20). A pin opening 36 is positioned in the pivot region 34.

The movable element 14 is formed having a body 40, a handle 42 and a cutting head 44. The head 44 includes a rear side 46 and a cutting blade 48. The blade 48 is short relative to the handle 42 to provide a substantial amount of leverage for strap cutting. The bottom or rear side 46 of the head can be curved (as illustrated at 50) to facilitate urging the head 44 between the strap S and the load when the strap is (highly) tensioned about the load.

The head 44 includes a pivot region 52 having a pin opening 54. The pivot region 52 is narrower than the cutting blade 48 to maintain the mated pivot regions 34, 52 about the same width of the tool 10 overall, while providing a wide cutting blade 48 for increased strength.

The handle 42, unlike known cutting tools is a looped or closed handle that includes an outer guard 56. This permits greater gripping strength and increased control of the tool 10 in both the cutting and releasing directions.

Both the fixed 12 and movable 14 elements include inwardly projecting stubs 58, 60. The stubs 58, 60 can be used to secure a spring 62 or like biasing element to bias the tool 10 to the open position.

Figure 9:
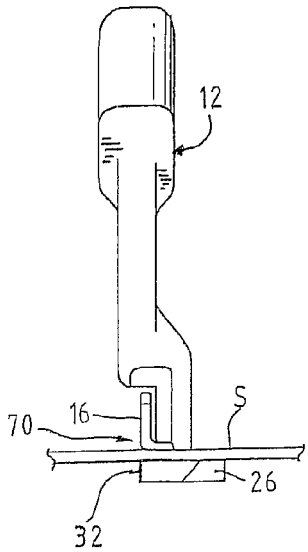
FIG. 9 is a front view of the fixed element with the cutter guard in place adjacent to the element to show the guard overlying a portion of the anvil.

The cutting tool 10 includes the cutter guard 16 that is mounted to the pivot pin 18. In a present tool 10 the guard 16 includes a body 66 (that is mounted by the pin 18) and a flange 68 that projects transverse to the body 66. The guard 16 is mounted with the body 66 between the fixed 12 and movable 14 elements as seen in the broken away portion of the fixed element 12 in FIG. 1. The flange 68 extends over the fixed body anvil 28 (the fixed blade) as illustrated in FIG. 9. In this manner, the strap S to be cut can be positioned on the anvil 28, inserted into the space 70 between the flange 68 and the anvil 28. This holds the strap S down on the anvil 28 during cutting and prevents the strap S from recoiling off of (up from) the anvil 28 as the cut is being made. In that the strap S can be manufactured from steel, the strap may tend to recoil or "jump" from the anvil 28 as the cut is finished. The guard 16 prevents this recoil or jumping, and thus facilitates maintaining control of the severed strap S.

In addition, the guard 16 also reduces the opportunity for the operator to inadvertently place his or fingers between the blades 34, 52 (in the jaw 72 of the tool 10). The guard flange 68 prevents an operator's finger from slipping under the movable blade 14 and the guard body 66 prevents a finger from being nipped between the blades at the jaw 72.

Those skilled in the art will recognize the various shapes, sizes and configurations that the guard 16 can have and provide the strap hold-down and accident prevention features.

Those skilled in the art will recognize that the present invention has been described with reference to a side action crimp sealing tool, but that the invention is equally well applicable to known top action sealing tools as well.

All patents referred to herein, are hereby incorporated herein by reference, whether or not specifically done so within the text of this disclosure.

In the disclosures, the words "a" or "an" are to be taken to include both the singular and the plural. Conversely, any reference to plural items shall, where appropriate, include the singular. From the foregoing it will be observed that numerous modification and variations can be effectuated without departing from the true spirit and scope of the novel concepts of the present invention. It is to be understood that no limitation with respect to the specific embodiments illustrated is intended or should be inferred. The disclosure is intended to cover by the appended claims all such modifications as fall within the scope of the claims.

What is claimed is:

1. A cutting tool for strap comprising:

a fixed element having a body, a grip extending from an end of the body and an anvil, the anvil having a first cutting edge, the fixed element body defining a pivot region between the first cutting edge and the grip;

a movable element having a body, a handle and a cutting head, the cutting head defining a second cutting edge, the movable element body defining a pivot region between the second cutting edge and the handle, the movable element and the fixed element operably connected to one another at their respective pivot regions by a pivot element, the fixed element first cutting edge and the movable element second cutting edge defining a jaw; and a cutter guard having a flange disposed to overlie a portion of the fixed element anvil to provide an opening between the flange and the anvil to hold down the strap during a cutting operation, wherein the cutter guard includes a body disposed, in part, between the fixed and the movable elements, the cutter guard mounted to the pivot element between the fixed and the movable elements.

2. The cutting tool in accordance with claim 1 wherein the cutter guard is operably connected to the fixed element and the movable element by the pivot element.

3. The cutting tool in accordance with claim 2 wherein the cutter guard is an L-shaped element.

4. The cutting tool in accordance with claim 1 wherein the movable element handle is formed as an enclosed handle.

5. The cutting tool in accordance with claim 4 wherein the handle is formed as a loop.

6. The cutting tool in accordance with claim 1 wherein the fixed element body includes a foot, and wherein the anvil is formed integral with the foot.

7. The cutting tool in accordance with claim 1 wherein the movable element includes an inwardly projecting stub between the pivot region and the handle and wherein the fixed element includes an inwardly projecting stub between the pivot region and the grip opposite of the movable element stub, and wherein the tool includes a biasing element extending between the elements at the stubs to bias the tool to an open position.

* * * * *